US006535224B2

(12) United States Patent
Kuriyama et al.

(10) Patent No.: US 6,535,224 B2
(45) **Date of Patent: *Mar. 18, 2003**

(54) DISPLAY DEVICE

(75) Inventors: Hirohito Kuriyama, Kawasaki (JP); Katsuhiro Ishida, Kawasaki (JP); Akira Yamamoto, Kawasaki (JP); Ayahito Kojima, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/458,809

(22) Filed: Dec. 10, 1999

(65) Prior Publication Data

US 2002/0126139 A1 Sep. 12, 2002

(30) Foreign Application Priority Data

Dec. 24, 1998 (JP) ..... 10-367817
Nov. 10, 1999 (JP) ..... 11-320231

(51) Int. Cl.[7] ..... G09G 5/10
(52) U.S. Cl. ..... 345/690; 345/63; 345/60
(58) Field of Search ..... 345/60, 61, 62, 345/63, 87, 88, 89, 98, 100, 690, 691, 692, 693

(56) References Cited

U.S. PATENT DOCUMENTS 5,757,343 A * 5/1998 Nagakubo ..... 345/63

FOREIGN PATENT DOCUMENTS

GB 2 129 635 A * 5/1984 ..... H04N/5/52
JP 03 231287 A * 10/1991 ..... G09G/3/36
JP 06 259034 A * 9/1994 ..... G09G/3/20

* cited by examiner

*Primary Examiner*—Xiao Wu
(74) *Attorney, Agent, or Firm*—Staas & Halsey LLP

(57) ABSTRACT

The present invention relates to a display device including an interface device, which can prevent from reducing a resolving power of gray scales for a dark picture signal is provided. The interface device according to the present invention is provided to prevent from decreasing a resolving power of luminance gray scales by setting a dynamic range of an analog digital converter according to a peak value of an analog picture signal. Further, a luminance control signal for determining a luminous level of the picture to be displayed is set according to the peak value of the analog picture signal. As the result, the interface device according to the present invention can generate a display signal displaying a picture having a sufficient resolving power of gray scales with a luminance (brightness) required for the darkness, even if a dark picture, of which analog picture signal is comparatively small, is generated.

13 Claims, 15 Drawing Sheets

Structural diagram of display device

Structural diagram of display device

Analog picture signal and digital display signal

Luminous frequency(Fsus) and the number of sustained discharges in each sub-frame Relationship of analog picture signal, dynamic range(Vref) and maximum luminance value(VBC)

FIG. 5

| | VPK | VAV | Type of picture | Gray scale control method | Dynamic range Vref | Luminance control signal BCONT |
|---|---|---|---|---|---|---|
| 1 | large | large | Entirely bright picture | Normal control | $(V_{PK}+V_{AV})/2 \simeq V_{PK} \simeq V_R$ | $V_{BC} \times (V_{ref}/V_R) \simeq V_{BC}$ |
| 2 | large | middle | Dynamic range for darkness and brightness is wide | Normal control | $(V_{PK}+V_{AV})/2 \simeq \frac{3}{4} V_{PK} \simeq \frac{3}{4} V_R$ | $V_{BC} \times (V_{ref}/V_R) \simeq \frac{3}{4} V_{BC}$ |
| 3 | large | small | Entirely dark picture one of which part is extremely bright | Emphasizing a representation of dark section | $(V_{PK}+V_{AV})/2 \simeq \frac{4}{7} V_{PK} \simeq \frac{4}{7} V_R$ | $V_{BC} \times (V_{ref}/V_R) \simeq \frac{4}{7} V_{BC}$ |
| 4 | middle | middle | Entirely intermediate bright picture | Lowering a representation of bright section | $(V_{PK}+V_{AV})/2 \simeq V_{PK} \simeq \frac{1}{2} V_R$ | $V_{BC} \times (V_{ref}/V_R) \simeq V_{BC} \times \frac{V_{PK}}{V_R} = \frac{1}{2} V_{BC}$ |
| 5 | middle | small | Entirely dark picture one of which is bright a little | Emphasizing a representation of dark section | $(V_{PK}+V_{AV})/2 \simeq \frac{1}{3} V_R$ | $V_{BC} \times (V_{ref}/V_R) \simeq \frac{1}{3} V_{BC}$ |
| 6 | small | small | Entirely dark picture | Seriously considering a representation of dark section | $(V_{PK}+V_{AV})/2 \simeq V_{PK} = \frac{1}{4} V_R$ | $V_{BC} \times (V_{ref}/V_R) \simeq \frac{1}{4} V_R$ |

Dynamic range and brightness control signal generating section

Signal level detecting circuit

Structural diagram of display device in the second embodiment

Histogram

Relationship between histogram distributions and selection siganls (1)

| Histogram distribution | DSEL | | Conversion table |
|---|---|---|---|
| | DSEL1 | DSEL2 | |
| A | H | H | RD 9:0 → CRD 9:0 |
| A | H | L | |
| B | L | H | RD 8:0 → CRD 9:0 |
| C | L | L | RD 7:0 → CRD 9:0 |

Conversion table (1)

Luminous frequency controller

Relationship between histogram distributions and selection siganls (2)

| Histogram distribution | DSEL | | Conversion table |
|---|---|---|---|
| | DSEL1 | DSEL2 | |
| A | H | H | RD 9:2 → CRD 7:0 |
| A | H | L | |
| B | L | H | RD 8:1 → CRD 7:0 |
| C | L | L | RD 7:0 → CRD 7:0 |

Conversion table (2)

DISPLAY DEVICE

BACKGROUND OF THE INVENTION

1. Field of the Invention

The present invention relates to an interface device, to which an analog picture signal is inputted and converted to a digital display signal, and to a converting circuit for converting a digital display signal to an optimum digital display signal, and more particularly, to a display device having an interface device capable of preventing the degradation of the resolving power of a gray scale corresponding to an analog picture signal, and of reproducing proper luminance, which corresponds to an analog picture signal, and to a display device having a converting circuit for preventing the degradation of the resolving power of a gray scale corresponding to a supplied display signal.

2. Description of the Related Art

A flat display device, such as a plasma display device for a large screen, which can provide a high-lightened display, a middle or small type liquid crystal display, has been provided that satisfies a demand for thinning and reducing the size of display device for a computer or a home TV video receiver. These flat display devices include an interface device, to which an analog picture signal is ordinarily input, converting the input signal into a digital display signal and driving a display panel according to the digital display signal.

The digital display signal of these flat display devices is generated by quantizing (analog-digital converting) the analog picture signal in an analog-digital converter of the interface device. A maximum standard value of the analog picture signal is fixed to a dynamic range of the analog-digital converter in the conventional interface device.

FIG. 15 shows a relationship between the analog picture signal and the converted digital display signal in the conventional plasma display device. An analog picture signal $V_{in}$ having a ramp waveform and digital display signals D0 to D7, which are analog-digital converted in the interface device, are shown in FIG. 15. A luminance control signal BCA, which is adjusted from an external device, and a luminous frequency $F_{sus}$ corresponding to the luminance control signal BCA are also shown in FIG. 15. In FIG. 15, both the luminance control signal BCA and the luminous frequency $F_{sus}$ are respectively fixed to each maximum value.

In the example of FIG. 15, a maximum amplitude level of the analog picture signal $V_{in}$ is equivalent to a dynamic range $V_{ref}$ of the analog-digital converter (approximately 100%) in a frame K, while the level is approximately 50% of the dynamic range $V_{ref}$ in a frame K+1. Further, the level is approximately 25% of the dynamic range $V_{ref}$ in a frame K+2.

In this case, in the frame K, the analog picture signal $V_{in}$ is allocated all for the number of gray scales represented by the 8-bit digital display signals D0 to D7. In other words, the maximum number of luminous gray scales (256 gray scales) is employed in the frame K, while the analog picture signal $V_{in}$ is allocated only for the number of gray scales (128 gray scales) represented by 7-bit digital display signals in the frame K+1. Further, in the frame K+2, the analog picture signal $V_{in}$ is allocated only for the number of gray scales (64 gray scales) represented by 6-bit digital display signals.

As described above, since the maximum standard value uniformly corresponds to the dynamic range $V_{ref}$ for the analog picture signal in the conventional interface device, the luminance of converted digital display signal can be displayed, as it is. However, this causes a problem such that the resolving power of gray scales is reduced, when the analog picture signal $V_{in}$ represents a comparatively dark picture having only a lower luminous region, like the frame K+2. If an insufficient resolving power of gray scales is given to such the dark picture, it is impossible to represent the luminance (brightness) smoothly changing in the dark picture, thereby lacking a detail expression for the picture.

Further, there are also cases, wherein the display device is directly supplied with a digital display signal from a computer or other external machine, and displays an image in accordance therewith. In this case, the same as described above, when a picture is relatively dark, the supplied display signal may not be making use of all of the full range of the gray scales thereof, and when this happens, it is only possible to provide insufficient gray scale resolving power (gray scale resolution) for a dark picture.

SUMMARY OF THE INVENTION

Accordingly, it is an object of the present invention to provide a display device including an interface device whereby a digital display signal having a resolving power of gray scales enough to represent a dark picture can be generated.

To achieve the above-described objects, an interface device according to the present invention is provided to prevent from reducing a resolving power of luminous gray scales by setting a dynamic range of an analog-digital converter according to a peak value of an analog picture signal. Further, a luminance control signal for determining a luminous level of the picture to be displayed is set according to the peak value of the analog picture signal. In the interface device according to the present invention, therefore, even when a dark picture, of which analog picture signal level is comparatively small, is displayed, a display signal for displaying a picture having a sufficient resolving power of gray scales with a luminance (brightness) required for the darkness of the picture can be generated.

BRIEF DESCRIPTION OF THE DRAWINGS

FIG. 5 is a table showing a relationship between the dynamic range and the luminance control signal for six type picture signals.

DESCRIPTION OF THE PREFERRED EMBODIMENTS

Hereinafter, preferred embodiments of the present invention are described with reference to the drawings. However, the technical scope of the present invention is not limited to these embodiments. Although the present invention relates to a display device displaying a picture by employing a digital display signal converted from an analog picture signal of a plasma display device, a liquid crystal display device, and so on, the following embodiments will be explained by employing the plasma display device as one example.

First Embodiment

Figure 1:
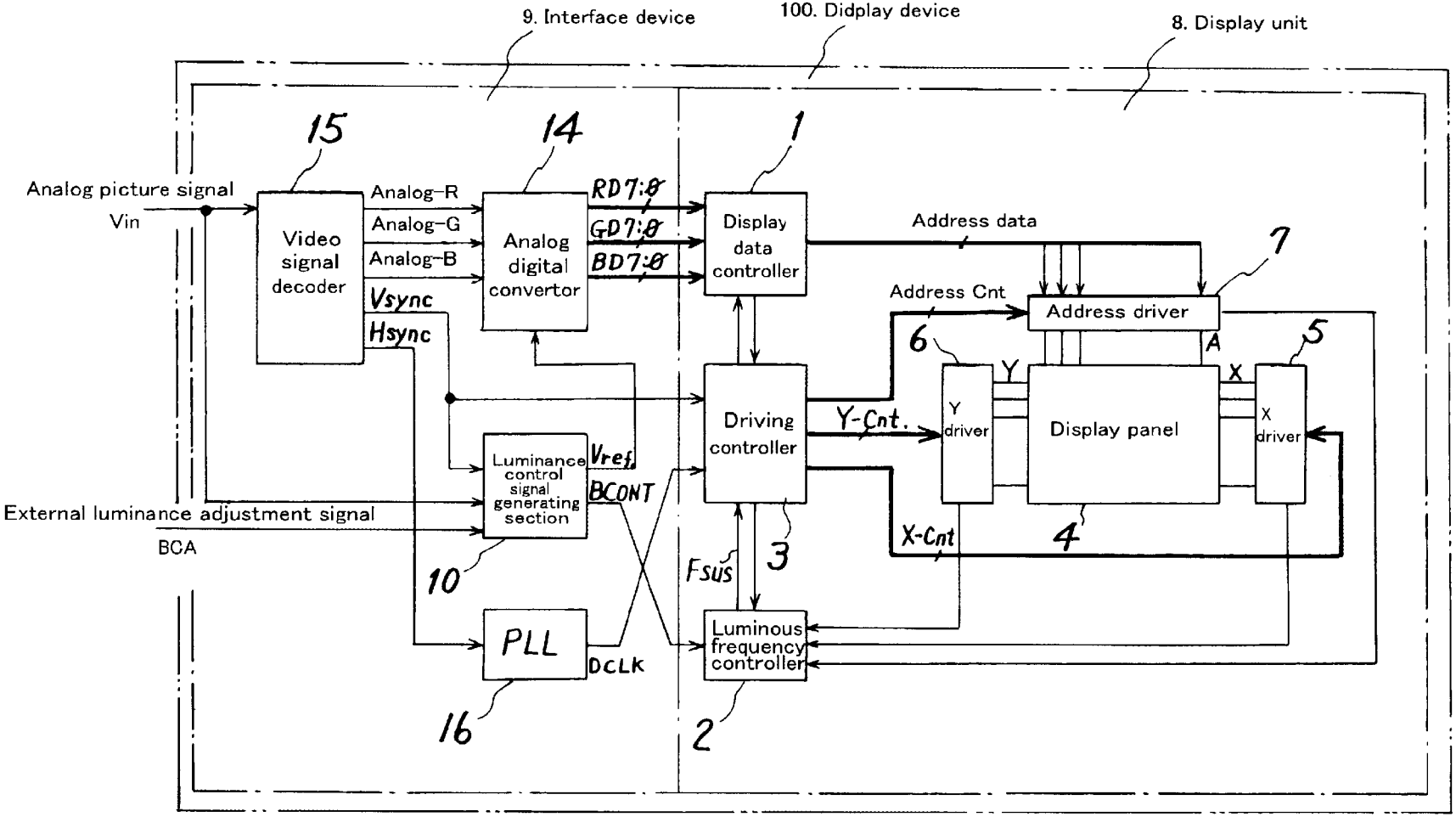
FIG. 1 is a structural diagram of a plasma display device according to the present invention.

FIG. 1 is a structural diagram of the plasma display device according to the present invention. The display device 100 in FIG. 1 is composed of a display unit 8 having a display panel 4 and an interface device 9. The interface device 9, to which a composite signal $V_{in}$ including the analog picture signal is supplied, generates digital RGB display signals RD, GD, BD, a luminance control signal BCONT, a vertical synchronization signal $V_{sync}$ and a dot clock DCLK, and supplies them to the display unit 8. The digital display signals RD, GD and BD are 8-bit digital signals, respectively. The display unit 8 displays a picture indicated by the digital display signals RD, GD and BD on the display panel 4, in synchronism with the vertical synchronization signal $V_{sync}$ and the dot clock DCLK. In this case, the display unit 8 generates a luminous frequency $F_{sus}$ for determining the luminance (brightness) of the plasma display panel, according to the luminance control signal BCONT.

The interface device 9 includes a video signal decoder 15, to which the composite signal $V_{in}$ including the analog picture signal is supplied, divides the composite signal $V_{in}$ into analog picture signals R, G and B, the vertical synchronization signal $V_{sync}$ and a horizontal synchronization signal $H_{sync}$. The interface device 9 further includes a data converter 14, which is an analog-digital converter, converting the analog picture signals R, G and B to 8-bit digital display signals RD, GD and BD. The analog-digital conversion is performed according to the dynamic range $V_{ref}$.

The composite signal $V_{in}$, including the analog picture signal is also supplied to a dynamic range $V_{ref}$ and luminance control signal BCONT generating section 10 in the interface device 9. The vertical synchronization signal $V_{sync}$ indicating one frame period is supplied from the video signal decoder 15 to the generating section 10. Further a luminance adjustment signal BCA is also supplied from an external device to the generating section 10. The generating section 10 generates the optimal dynamic range $V_{ref}$ according to these supplied signals, and supplies the dynamic range $V_{ref}$ to the data converter 14. The generating section 10 further generates the optimal luminance control signal BCONT according to these supplied signals and supplies the luminance control signal BCONT to a luminous frequency controller 2 in the display unit 8. The dynamic range $V_{ref}$ is a voltage signal indicating the dynamic range for analog-digital conversion, and is variably set corresponding to the analog picture signal, according to an algorithm, which is later described. Additionally, the luminance control signal BCONT for determining the number of sustain discharges in the plasma display panel is variably set corresponding to the analog picture signal, according to an algorithm, which is later described, together with the dynamic range $V_{ref}$. The luminance adjustment signal BCONT is also variably set by the external luminous adjustment signal BCA given from the external device.

A PLL circuit 16 in the interface device 9, to which the horizontal synchronization signal $H_{sync}$ is supplied from the video signal decoder 15, generates the dot clock DCLK of which frequency is corresponding to the number of dots on a synchronization display line, in synchronism with the horizontal signal $H_{sync}$.

The plasma display panel 4 is an AC type surface discharge plasma display panel having three electrodes X, Y, A, for example. In the plasma display panel, X electrodes are driven by an X driver 5, Y electrodes are driven by an Y driver 6 and an address electrode (A electrode) is driven by an address driver 7. A driving controller 3, to which the vertical synchronization signal $V_{sync}$, the dot clock DCLK and the luminous frequency $F_{sus}$ are supplied, controls timing and voltage for driving each driver, according to a prescribed sequence. A display data controller 1, to which the digital display signals RD, GD and BD are input, generates address data for driving the address electrode, and supplies it to the address driver 7. In other words, the display data controller 1 executes a multiple level gray scaled data process and a data matrix conversion process to convert the display data in each dot (pixel) into display data for driving the address electrode in each plural sub-frame.

The driving sequence of a plasma display panel is fully described in U.S. Pat. No. 5,818,319, for example. The outline will be now explained. In a plasma display panel, one frame is composed of plural sub-frames, each of which is weighted relating to the luminance, the luminous gray scale display is provided by lightening or not a cell (or is discharged) in each of the plural sub-frames. As described later, each sub-frame consists of a reset period, for full screen erasing by a commonly used X electrode; an addressing period, for driving the address electrode according to address data, while scanning Y electrodes so as to lighten on desired cell and accumulate wall charges; and a sustain discharge period, for performing sustain discharges for the number of weighted sub frames by applying an alternating voltage between the X electrode and the Y electrodes. The small number of discharges during the sustain discharge period lowers the luminance, while the large number of discharges highlights the luminance. The number of discharges is determined by the luminous frequency $F_{sus}$.

Figure 2:
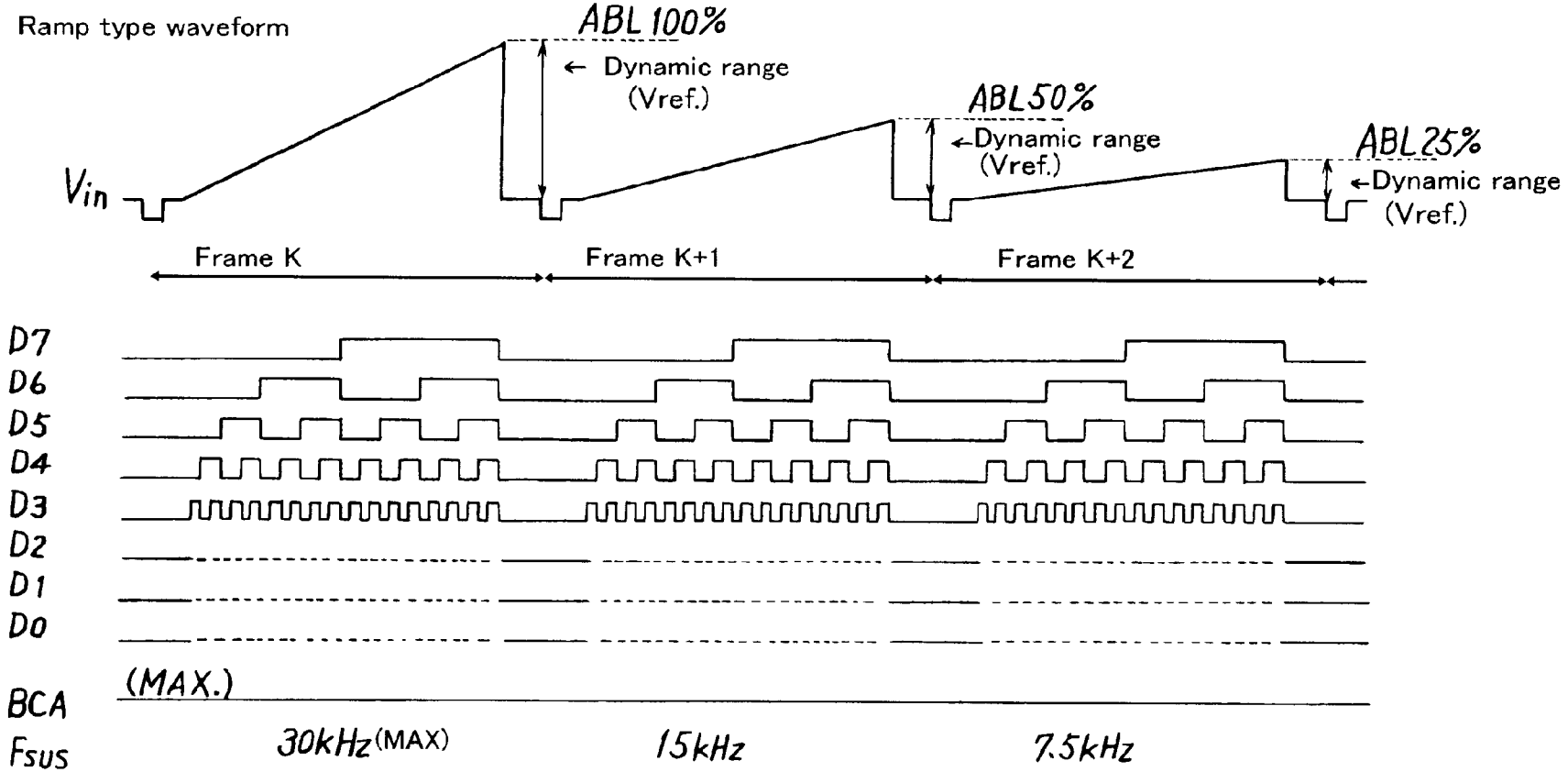
FIG. 2 shows a relationship between an analog picture signal and converted digital display signals in the plasma display device according to the present invention.
Figure 15:
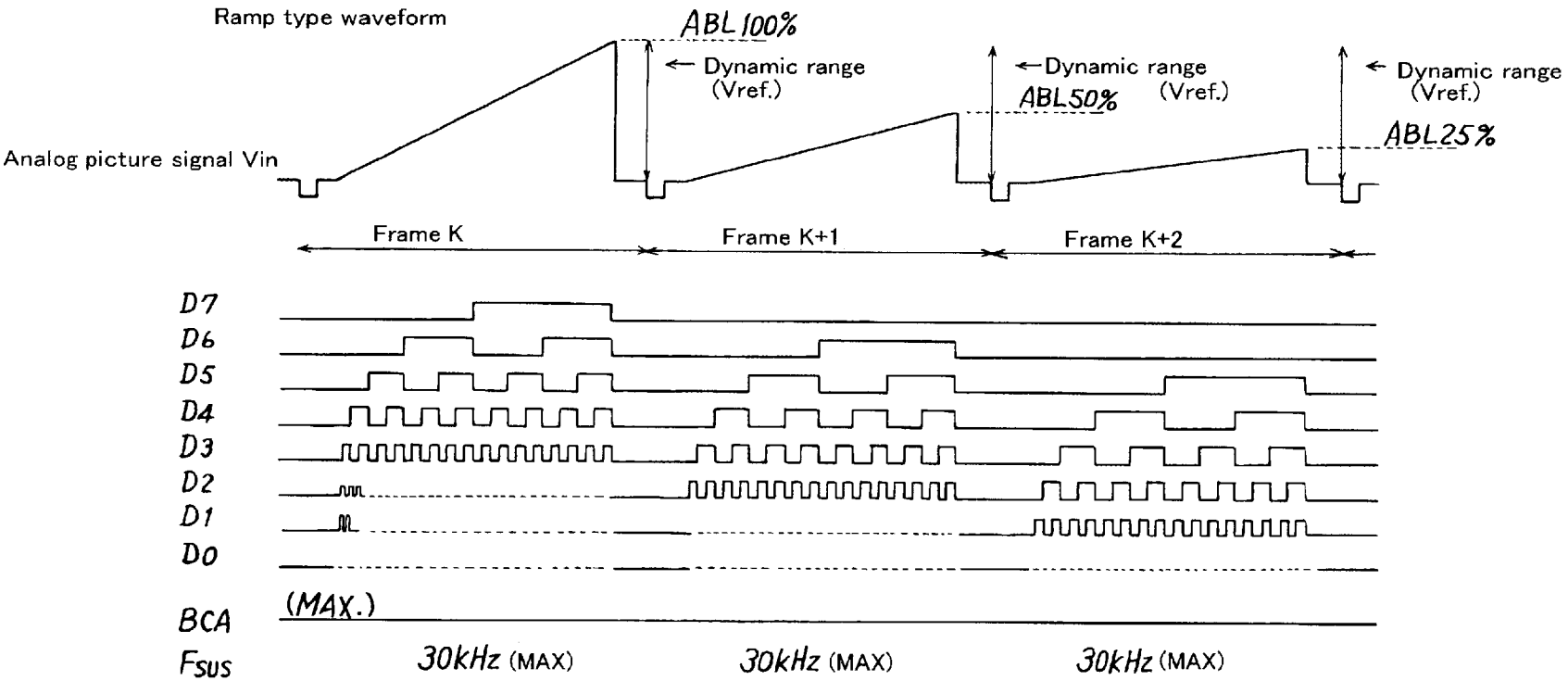
FIG. 15 Prior art
FIG. 15 is a diagram showing a relationship between the analog picture signal and the converted digital display signal in the conventional plasma display device.

FIG. 2 is a diagram showing a relationship between the analog picture signal and the converted digital display signal in the plasma display device according to the embodiment of the present invention. In FIG. 2, the converted digital display signals D0 to D7 at the time the analog picture signal $V_{in}$ having the same lamp waveform as that explained in FIG. 15, as a prior art, is given in three frames K, K+1 and K+2 are shown. The external luminance control signal BCA is fixed to the maximum value in this case, too, for simplicity.

The analog picture signal $V_{in}$ includes signals of which amplitudes are from the lowest level to the maximum level, in the frame K, as shown in FIG. 2. In this case, the dynamic range $V_{ref}$ is set to the maximum value corresponding to the maximum peak value. As the result, the analog picture signal $V_{in}$ has the maximum resolving power of luminous gray scales (256 gray scales) represented by the 8-bit digital display signal D0 to D7. Corresponding to that, the luminous frequency $F_{sus}$ is also set to the maximum frequency, 30 kHz, for example. Therefore, the image to be displayed has brightness corresponding to the luminous level represented by the analog picture signal $V_{in}$. The luminous frequency controller 2 generates the luminous frequency $F_{sus}$, according to the luminance control signal BCONT, as described above.

Although the lower three bits D2, D1 and D0 of the digital display signal are respectively changed, it is difficult to illustrate them in the diagram, because of the minute changes, and therefore, they are shown by broken lines in FIG. 2 for simplicity.

The analog picture signal $V_{in}$ includes signals of which amplitudes are from the lowest level to the middle level, which is approximately 50% of the maximum standard value, in the frame K+1. In this case, the dynamic range $V_{ref}$ is set to a level that is approximately 50% of that in the frame K. The maximum peak value of the analog picture signal $V_{in}$ is lowered as the result, however, the resolving power of 256 gray scales represented by the 8-bit digital display signals D0 to D7 is sustained. Therefore, the detailed change in the luminance can be expressed in the picture to be displayed by using the maximum resolving power. As the dynamic range $V_{ref}$ is set to an approximate half value, the luminous frequency $F_{sus}$ is set to approximately half of that in the frame K, 15 KHz. As the result, the image to be displayed has brightness corresponding to the luminous value represented by the analog picture signal $V_{in}$.

In the frame K+2, the analog picture signal $V_{in}$ includes signals of which amplitudes are from the lowest level to a lower level that is approximately 25% of the maximum standard value. In this case, the dynamic range $V_{ref}$ is set to a level that is approximately 25% of that in the frame K. Although the maximum peak value of the analog picture signal $V_{in}$ lowers extensively, as the result, the resolving power of 256 gray scales represented by the 8-bit digital display signals D0 to D7 is sustained. Therefore, the detailed change in the luminance of image to be displayed can be represented by using the maximum resolving power. As the dynamic range $V_{ref}$ is set to approximately one fourth of the maximum value, the luminous frequency $F_{sus}$ is set to approximately one fourth of that in the frame K, i.e., 7.5 kHz. As the result, the image to be displayed has brightness corresponding to the luminous value represented by the analog picture signal $V_{in}$. That is, although the image is a dark picture, the change in the luminance of the image can be expressed by using the maximum resolving power.

Figure 3:
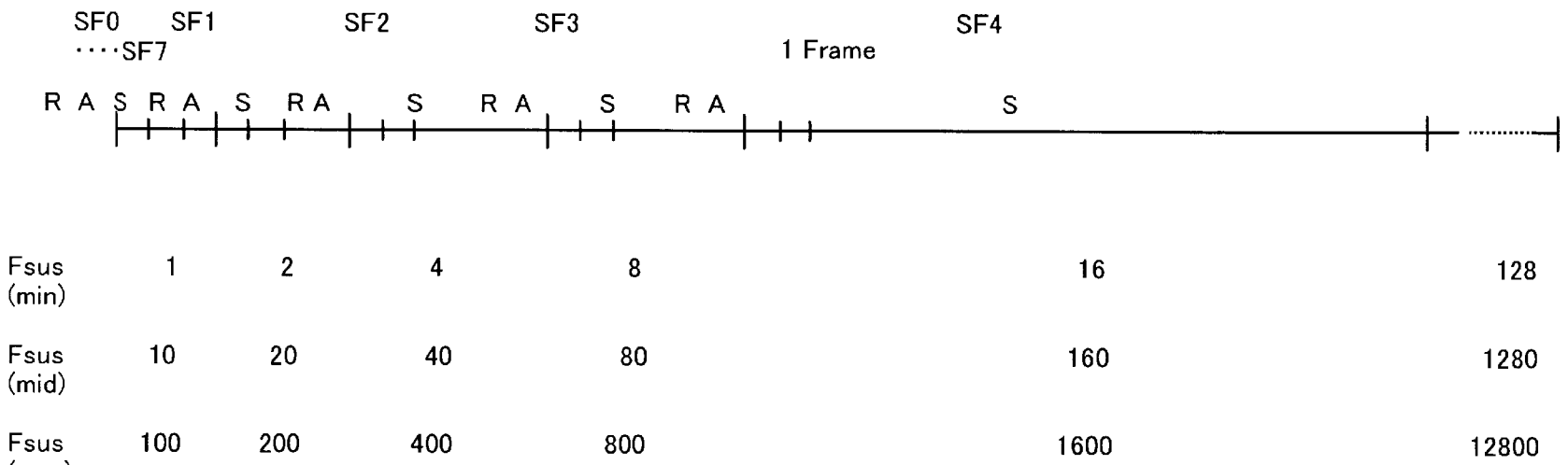
FIG. 3 is a diagram showing a relationship between a luminance frequency $F_{sus}$ and number of sustain discharges in each sub-frame.

FIG. 3 shows a diagram showing a relationship between the luminous frequency $F_{sus}$ and the number of sustain discharges in sub-frames. In FIG. 3, one frame is divided into eight sub-frames SF0 to SF7 weighted relating to the luminance, for example. The relationship between the luminous frequency and the total number of sustain discharges in one frame can be expressed as:

$$F_{sus}=(\text{the total number of sustain discharges in one frame})\times(\text{frame frequency})$$

Each sub-frame consists of a reset period R, for full panel erasing; an addressing period A, for selectively discharging on a cell; and a sustain discharge period S, for providing a prescribed number of sustain discharges for the cell lightened during the address period A. The luminous value of each sub-frame can be determined by the number of the sustain discharges during the sustain discharge period S. In other words, as the number of sustain discharges increases, the luminous value in the sub-frame increases (becomes brighter). In the example of FIG. 3, the number of sustain discharges is the least in the sub-frame SF0 and the number is the most in the sub-frame SF7. Therefore, the ratios for the numbers of sustain discharges in eight sub-frames SF0 to SF7 are set as follows:

SF0: SF1: SF2 . . . :SF7=1:2:4: . . . :128

Therefore, the luminance for 256 gray scales can be displayed by combining these sub-frames.

As shown in FIG. 3, it is assumed that the luminous frequency $F_{sus}$ is set to the minimum level, for example. Then, the driving controller 3 controls the number of the sustain discharges in each sub-frame to 1, 2, 4, 8, 16 . . . 128. When the luminous frequency $F_{sus}$ is set to an approximate middle level, the driving controller 3 controls the number of sustain discharges in each sub-frame to 10, 20, 40, 80, 160, . . . 1280m, for example. Further, if the luminous frequency $F_{sus}$ is set to the maximum level, the driving controller 3 controls the number of sustained discharges in each sub-frame to 100, 200, 400, 800, 1600, . . . 12800, for example.

As described above, an absolute value of the luminance can be changed and be set, keeping a ratio of weighting the luminance in each sub-frame. Therefore, the luminance to be displayed can be changed by changing and setting the luminous frequency $F_{sus}$ according to the luminance control signal BCONT generated by the generator 10 in the interface device 9.

Returning to FIG. 2, a relationship of the analog picture signal $V_{in}$, the dynamic range $V_{ref}$ and the luminous frequency $F_{sus}$ will be now explained as follows. In the present embodiment, the dynamic range $V_{ref}$ is set to a lower level, when the peak value of the analog picture signal $V_{in}$ is set to a lower level, to prevent from reducing the resolving power of luminous gray scales. Additionally, when the peak value of the analog picture signal $V_{in}$ is set to a lower level, the luminous frequency $F_{sus}$ for determining the luminous value of the picture to be displayed is set to a lower level. As the result, even when the level of the analog picture signal $V_{in}$ is comparatively small and the image is a dark picture, like in the frame K+2, it is possible to display the picture having luminance (brightness) corresponding to the darkness and the resolving power of gray scales.

Considering a type of picture signal in detail, however, it is preferable to finely adjust the settings of the dynamic range $V_{ref}$ and the luminous frequency $F_{sus}$ by using the average value of the analog picture signal.

Figure 4:
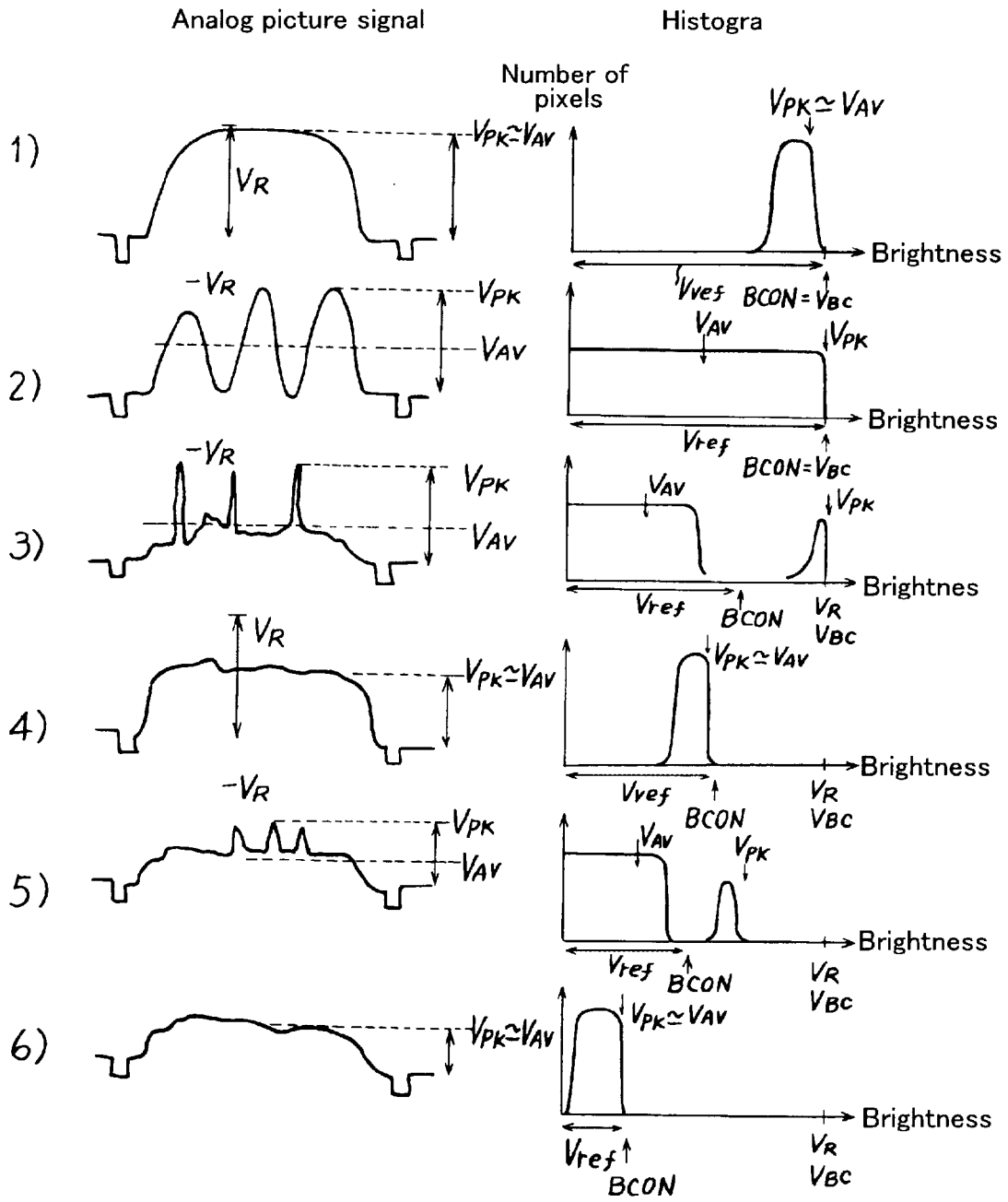
FIG. 4 is a diagram showing a relationship of the analog picture signal, a dynamic range and the maximum luminance value.

FIG. 4 is a diagram showing a relationship of the analog picture signal, the dynamic range and the maximum luminance. Six type analog picture signals and the corresponding histograms are shown as an example. Waveforms in one frame of the six analog picture signals are shown on the left section of FIG. 4. Further, each histogram on the right section of the FIG. 4 shows brightness (luminance) on the horizontal axis and the number of pixels on the horizontal axis. In FIG. 4, reference symbols $V_R$, $V_{PK}$ and $V_{av}$ independently denote the maximum standard voltage, a peak value and an average value of the analog picture signal. Additionally, reference symbol $V_{BC}$ denotes a voltage of the luminance control signal BCONT for the luminous display corresponding to the maximum standard voltage $V_R$.

The analog picture signal shown in (1) of FIG. 4 is used for an entirely brighter picture, and it is apparent from the histogram that signals each having almost high luminance (brightness) are included. In this case, both the peak value $V_{PK}$ and the average value $V_{AV}$ of the analog picture signal become large and become equivalent or very close value each other. Therefore, it is preferable that the dynamic range $V_{ref}$ becomes equivalent to the peak value $V_{PK}$ (=$V_R$) and the voltage value of the luminance control signal BCONT also becomes equivalent to a voltage $V_{BC}$ corresponding to the peak value $V_{PK}$ (=$V_R$).

The analog picture signal shown (2) of FIG. 4 is used for a picture having bright and dark sections. It is apparent from the histogram that signals having luminance (brightness) from the highest level to the lowest level are included. In this case, the peak value $V_{PK}$ of the analog signal is the maximum standard level $V_R$, and the average value $V_{AV}$ is an approximate middle level. Therefore, it is preferable that the dynamic range $V_{ref}$ becomes equivalent to the peak value $V_{PK}$ (=$V_R$) and the voltage value of the luminance control signal BCONT also becomes equivalent to the voltage $V_{BC}$ corresponding to the peak value $V_{PK}$ ($V_R$). Since the number of pixels for the highest luminance is less than that in the case of (1) of FIG. 4, however, the dynamic range $V_{ref}$ may be lowered than the peak value $V_{PK}$ (=$V_R$) and the voltage value of luminance control signal BCONT may be also lowered than the voltage $V_{BC}$ corresponding to the peak value $V_{PK}$ (=$V_R$) for example.

The analog picture signal shown in (3) of FIG. 4 is used for an entirely dark picture, one of which part is very bright. It is apparent from the histogram that signals each of which luminance is lower than the approximate middle level and signals having high luminance, which are largely away from the signals having lower luminance than the middle level, are included. In this case, the peak value $V_{PK}$ of the analog picture signal is approximately as large as the maximum standard voltage $V_R$, while the average value $V_{AV}$ becomes a very lower level. Therefore, it is preferable that the dynamic range $V_{ref}$ is slightly higher than the half of the peak value $V_{PK}$ (=$V_R$) and the voltage value of the luminance control signal BCONT is also slightly higher than the half of the voltage $V_{BC}$ corresponding to the peak value $V_{PK}$ (=$V_R$).

The analog picture signal shown in (4) of FIG. 4 is used for a picture having entirely intermediate brightness, and it is apparent from the histogram that signals having almost middle luminance are included. In this case, both the peak value $V_{PK}$ and the average value $V_{AV}$ of the analog picture signal are set to approximately half of the maximum standard voltage $V_R$. Therefore, it is preferable that the dynamic range $V_{ref}$ is set to the peak value $V_{PK}$ and the voltage value of the luminance control signal BCONT is also set to the voltage corresponding to the peak value $V_{PK}$.

The analog picture signal shown in (5) of FIG. 4 is used for an entirely dark picture, one of which part is slightly brighter. It is apparent from the histogram that signals having almost low luminance and signals having approximately intermediate level luminance being largely apart from the signals having almost low luminance are included. While the peak value $V_{PK}$ of the analog picture signal is approximately half of the maximum standard voltage $V_R$, in this case, the average value $V_{AV}$ becomes a very lower value. Therefore, it is preferable that the dynamic range $V_{ref}$ is set to an approximately middle value between the peak value $V_{PK}$ and the average value $V_{AV}$, and the voltage value of the luminance control signal BCONT is also set to a voltage corresponding to the middle value between the peak value $V_{PK}$ and the average value $V_{AV}$.

The analog picture signal shown in (6) of FIG. 4 is used for an entirely dark picture, and it is apparent from the histogram that signals having almost lower luminance are included. In this case, the peak value $V_{PK}$ and the average value $V_{AV}$ of the analog picture signal are set to the same level and the voltage is very lower than the maximum standard value $V_R$. Therefore, it is preferable that the dynamic range $V_{ref}$ is approximately equivalent to the peak value $V_{PK}$ and the voltage value of the luminance control signal BCONT is also set corresponding to the peak value $V_{PK}$.

Through the explanations of the above-described six type picture signals, it can be understood that when both the peak value $V_{PK}$ and the average value $V_{AV}$ of the analog picture signal are closed each other (the cases of (1), (4) and (6)), a picture having entirely equivalent brightness is displayed. On the contrary, when the peak value $V_{PK}$ and the average value $V_{AV}$ are differed (the cases of (3) and (5)), the average brightness depends on the average value $V_{AV}$, but a distribution for brightness depends on the peak value $V_{PK}$. In the present embodiment, both the dynamic range $V_{ref}$ and the luminance control signal BCONT are set according to a middle value between the peak value and the average value. That is, while the values are set according to the peak value, the dynamic range $V_{ref}$ and the luminance control signal BCONT are set by further pulling the set values down according to the average value.

FIG. 5 is a table showing relationships between the dynamic ranges and the luminance control signals for the six type picture signals shown in (1), (2), (3), (4), (5) and (6) of FIG. 4. As is explained above, the dynamic range and the luminance control signal are controlled according to the peak value of the analog picture signal, and further, these values are shifted to the lower level according to the average value, in a more preferable graduation controlling method. To generate the dynamic range $V_{ref}$ and the luminance control signal BCONT, each of which luminance is controlled in a uniform circuit formed by the interface device, therefore, it is preferable that both the dynamic range and the luminance control signal are set according to a middle value between the peak value $V_{PK}$ and the average value $V_{AV}$ (=($V_{PK}$+$V_{AV}$)/2) as an example.

In the table of FIG. 5, each voltage value of the dynamic range $V_{PK}$ and the luminance control signal BCONT, which is set according to the above-described method, is shown. In the case of the picture signal (1), the dynamic range $V_{ref}$ is set to an intermediate value ($V_{PK}$+$V_{AV}$)/2=$V_{PK}$=$V_R$ and the luminance control signal BCONT is set to a value (=$V_{BC}$×(($V_{PK}$+$V_{AV}$)/2)/$V_R$=$V_{BC}$), which is obtained by multiplying the intermediate value to a ratio ($V_{BC}$/$V_R$) of the maximum voltage $V_{BC}$ corresponding to the maximum standard voltage $V_R$ to the maximum standard voltage $V_R$.

Similarly to the case of the picture signal (1), in the case of picture signal (2), the dynamic range $V_{ref}$ is set to $3V_R/4$, and the luminance control signal BCONT is set to $3V_{BC}/4$, respectively. In the case of the picture signal (3), the dynamic range $V_{ref}$ is set to $4V_R/7$ and the luminance control signal BCONT is set to $4V_{BC}/7$, respectively. In the case of the picture signal (4), the dynamic range $V_{ref}$ is set to $V_R/2$ and the luminance control signal BCONT is set to $V_{BC}/2$, respectively. In the case of picture signal (5), the dynamic range $V_{ref}$ is set to $V_R/3$ and the luminance control signal BCONT is set to $V_{BC}/3$, respectively. In the case of picture signal (6), the dynamic range $V_{ref}$ is set to $V_R/4$ and the luminance signal BCONT is set to $V_{BC}/4$, respectively.

Figure 6:
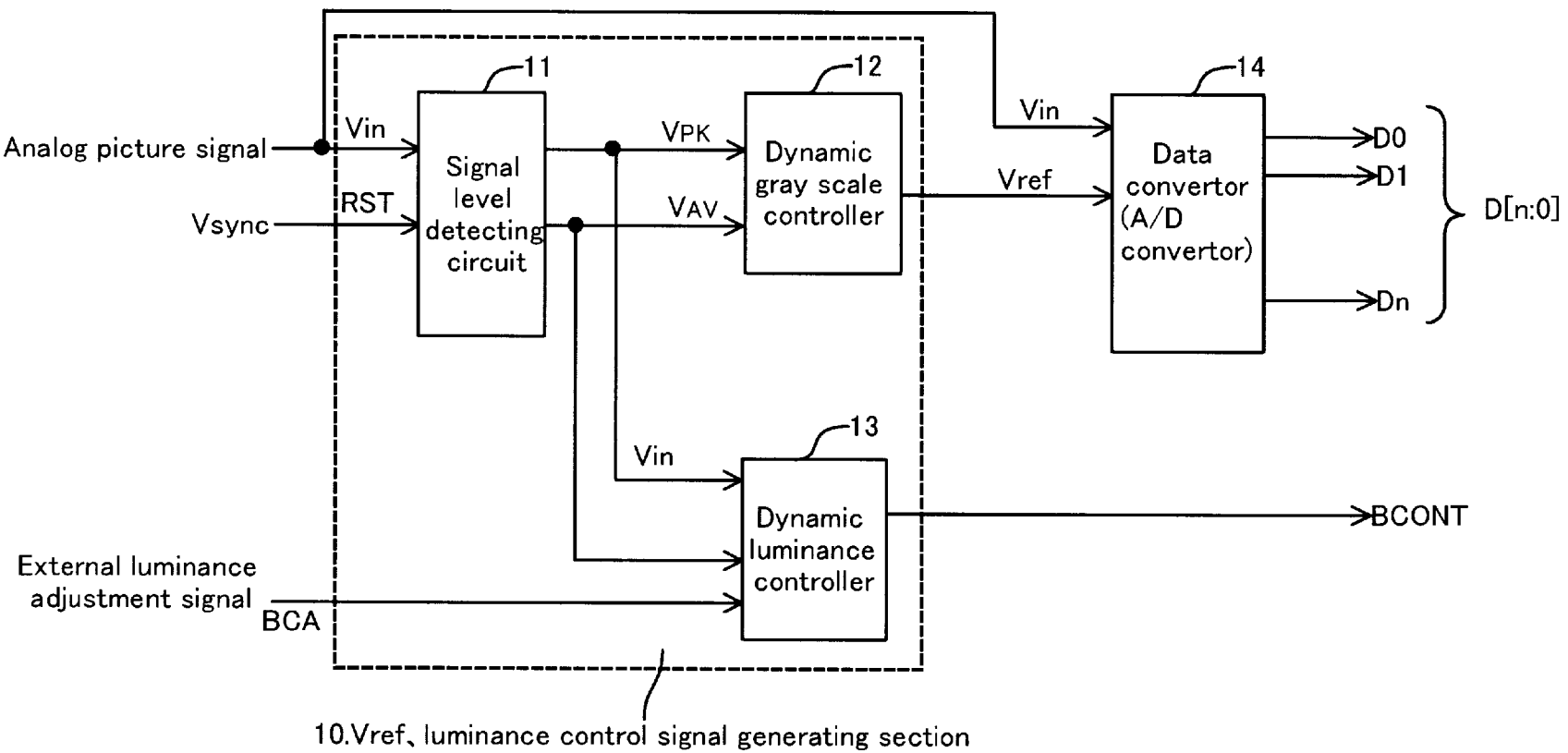
FIG. 6 shows a structure of the dynamic range and a luminance control signal generating section according to the present invention.

FIG. 6 shows a structure of a dynamic range and luminance control signal generating section according to the embodiment of the present invention. The generating section 10 shown in FIG. 6, to which the analog picture signal $V_{in}$ is supplied, includes a signal level detecting circuit 11, which detects the voltage peak value $V_{PK}$ and the average value $V_{AV}$ of the analog picture signal during a prescribed period. In the signal level detecting circuit 11, a vertical synchronization signal $V_{sync}$ is used as a resetting signal RST to obtain the peak value and the average value of the analog picture signal in one frame period, according to the embodiment of the present invention.

The detected peak and average values $V_{PK}$ and $V_{AV}$ are supplied to a dynamic gray scale controller 12 and a dynamic luminance controller 13. The external luminance control signal BCA supplied from an external device is also supplied to the dynamic luminance controller 13. The dynamic gray scale controller 12 dynamically generates the dynamic range $V_{ref}$ of a data converter (analog-digital converter) 14 corresponding to the peak and average values, according to the above-described algorithm, and supplies them to the data converter 14. Alternatively, the dynamic luminance controller 13 generates the luminance control signal BCONT corresponding to the peak and average values, according to the above-described algorithm. Further, the dynamic luminance controller 13 adjusts the luminance control signal BCONT concerning to the external luminance adjustment signal BCA.

Figure 7:
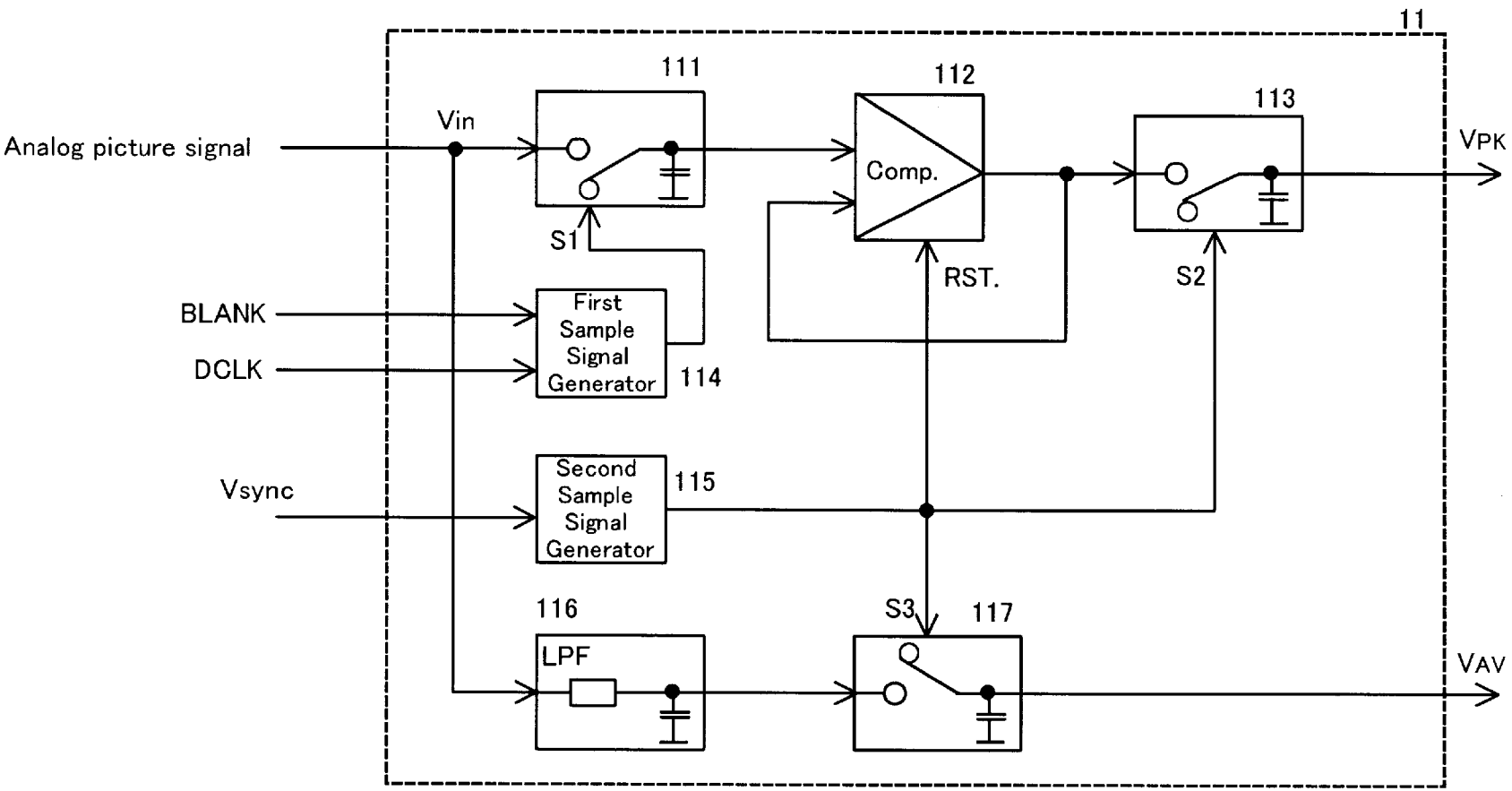
FIG. 7 is a detailed circuitry diagram of a signal level detecting circuit according to the present invention.

FIG. 7 is a detailed circuitry diagram of the signal level detecting circuit according to the embodiment of the present invention. The signal level detecting circuit 11 in FIG. 7 includes first, second, third sampling and holding circuits 111, 113 and 117. The signal level detecting circuit 11 further includes first and second sampling signal generating circuits 114, 115, for generating sampling signals S1, S2, S3, a comparator circuit 112, for comparing two input signals and outputting larger one from the two input signals, and a low-pass filter circuit (integrator) 116, for detecting an average value during one prescribed period of the analog picture signal $V_{in}$.

The first sampling signal generating circuit 114 generates the sampling signal S1 synchronized with the dot clock DCLK in an effective picture signal period except a blanking period, which is decided according to a blanking signal BLANK, and supplies the signal S1 to the first sampling and holding circuit 111. The sampling and holding circuit 111 holds and samples the voltage level of the analog picture signal $V_{in}$, in response to the sampling signal S1. The comparator circuit 112 is reset by the resetting signal RST, which is generated in synchronism with the vertical synchronization signal $V_{sync}$, and outputs the highest voltage level during one frame. The second sampling and holding circuit 113 holds outputs from the comparator circuit 112, in response to the sampling signal S2 generated by second sample signal generator 115 in synchronism to the vertical synchronization signal $V_{sync}$. Therefore, the second sampling and holding circuit 113 can output the highest level in one frame period of the analog picture signal as a peak value $V_{PK}$.

A low-pass filter 116, which is an integrator, detects an average voltage level in one frame period of the analog picture signal $V_{in}$, and the third sampling and holding circuit 117 holds the detected voltage level. Therefore, the third sampling and holding circuit 117 outputs the average voltage value $V_{AV}$ in one frame period of the analog picture signal.

Figure 8:
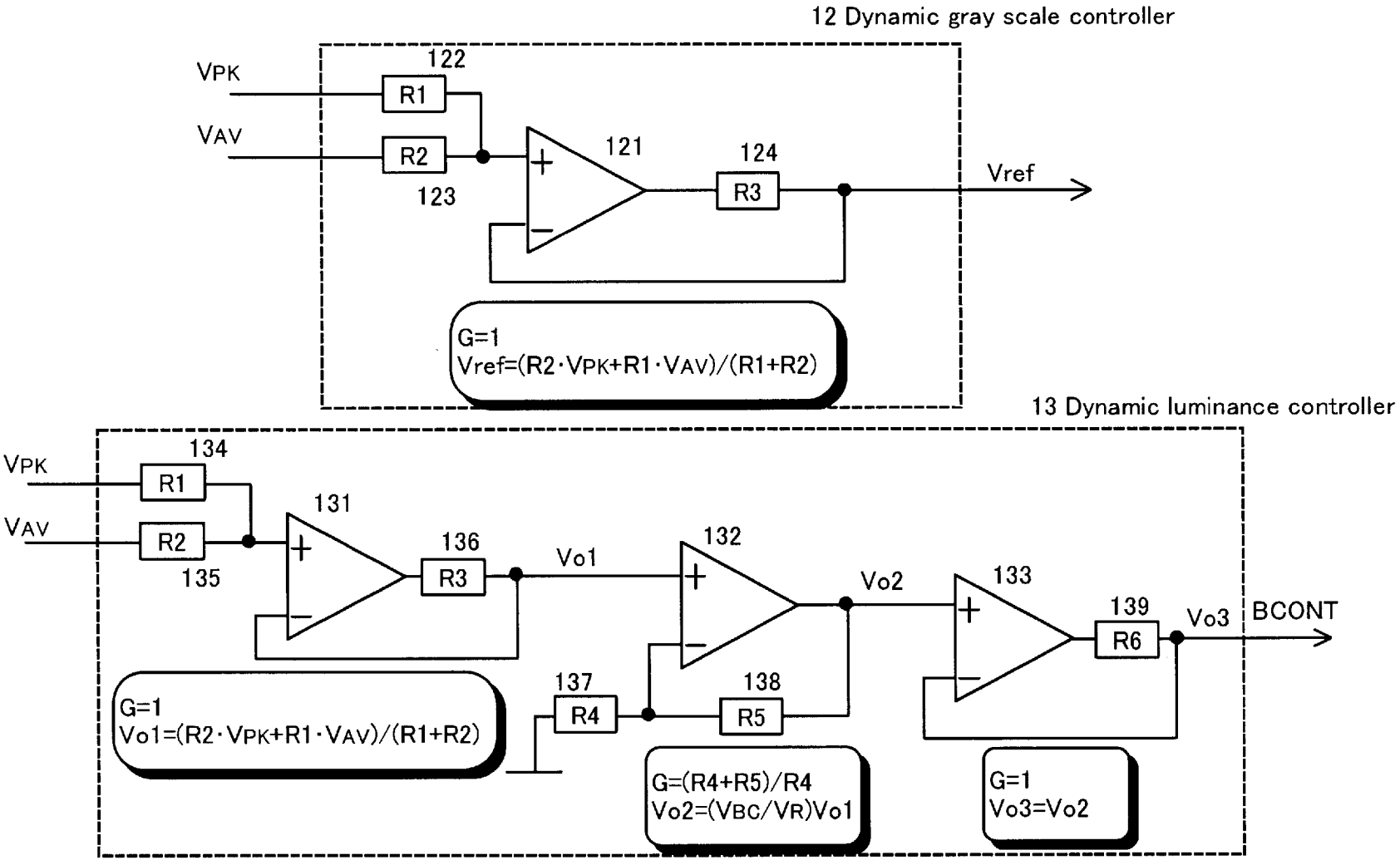
FIG. 8 is a circuitry diagram of a dynamic gray scale controller 12 and a dynamic luminance controller 13 according to the present invention.

FIG. 8 is a circuitry diagram of the dynamic gray scale controller 12 and the dynamic luminance controller 13 according to the embodiment of the present invention. As shown in FIG. 5, the controllers 12 and 13 respectively include a combination circuit of resistors and operational amplifiers to obtain the dynamic range $V_{ref}$ and luminance control signal BCONT from the peak value $V_{PK}$ and the average value $V_{AV}$.

The dynamic gray scale controller 12 is composed of an operational amplifier 121, input resistors 122, 123, and a feed back resistor 124. With this structure, a gain G of the operational amplifier 121 can be expressed, as shown in the diagram:

G=1 (buffer)

Where R1=R2, R3 (R6)<<R1 (R2) (R3 and R6 may be omitted). Since the peak and average values $V_{PK}$ and $V_{AV}$ are applied to respective input resistors 122 and 123, the output $V_{ref}$ of the operational amplifier can be expressed as: $V_{ref}=(V_{PK}+V_{AV})/2$.

The dynamic luminance controller 13 includes operational amplifiers 131, 132, a buffer circuit 133. The operational amplifier 131 and resistors 134, 135, 136 respectively have the same circuitry structure as those in the dynamic gray scale controller 12. Therefore, the gain (G) and the output $V_o1$ can be expressed similarly to the above-described case as follows:

$$V_o1=(V_{PK}+V_{AV})/2$$

On the other hand, an input resistor 137 and a feed back resistor 138 are provided on the second operational amplifier 132. Thereby, the gain G is set as shown in FIG. 8, as follows:

$$G=(R4+R5)/R4=V_{BC}/V_R$$

Where the resistor value is set as: $R5=(V_{BC}/V_R-1)\times R4$, $V_{BC} \geqq V_R$. Therefore, the output $V_o2$ can be expressed as to be:

$$V_o2=G\times V_o1=(V_{BC}\times(V_{PK}+V_{AV})/2)/V_R=V_{BC}\times V_{ref}/V_R.$$

That is, the second operational amplifier 132 converts the voltage $(V_{PK}+V_{AV})/2$, which is calculated by the operational amplifier 131, by a ratio $(V_{BC}/V_R)$, in accordance to the input range of the luminance control signal BCONT, which is employed for controlling the luminous frequency of the display device. In other word, when the voltage value of the luminance control signal BCONT corresponding to the value $V_R$ at the time the dynamic range $V_{ref}$ is the maximum value is set to $V_{BC}$ (maximum value), the amplifier 132 obtains the luminance control signal BCONT, linking to the setting of dynamic range $V_{ref}$.

By employing the above-described controllers, the interface device can generate the dynamic range $V_{ref}$ and the luminance control signal BCONT, according to the peak and average values $V_{PK}$ and $V_{AV}$ of the analog picture signal. It is also possible to express gray scales with the maximum resolving power at all times by setting the dynamic range of the analog-digital converter, according to the dynamic range $V_{ref}$. Further, it becomes possible to display with the luminance corresponding to the analog picture signal by setting the luminous frequency $F_{sus}$ of the plasma display panel, according to the luminance control signal BCONT.

Second Embodiment

Figure 9:
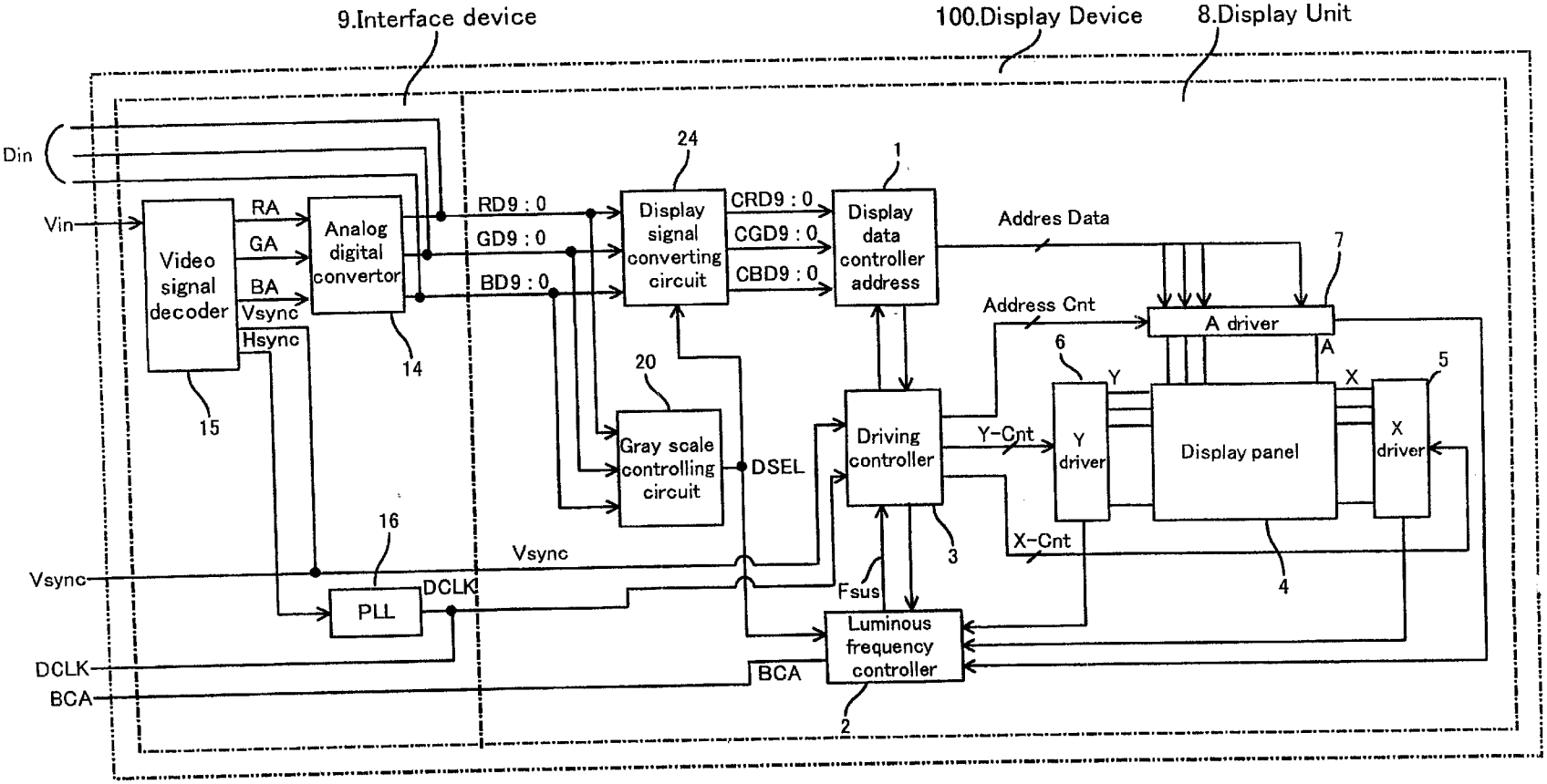
FIG. 9 is a block diagram of a plasma display device in a second embodiment.

FIG. 9 is a block diagram of a plasma display device in a second embodiment. The same reference numerals have been assigned to portions which correspond to FIG. 1. The plasma display device 100 constitutes a display unit 8 and an interface device 9. The interface device 9, the same as in the case of FIG. 1, converts an analog picture signal, which is a composite signal, to analog red, green and blue signals RA, GA, BA, a vertical synchronization signal vsync, and a horizontal synchronization signal Hsync, and then converts these analog display signals RA, GA, BA to digital display signals RD, GD, BD. Further, a dot clock DCLK is generated from the horizontal synchronization signal Hsync by a phase-locked loop (PLL) 16. The digital display signals RD, GD, BD, vertical synchronization signal vsync, and dot clock DCLK generated by the interface 9 are supplied to the display unit 8. There are also cases in which these digital display signals and so forth are supplied directly to the display unit 8 from outside.

In the second embodiment, there is provided inside the display unit 8 a function for controlling a luminance control signal, which controls display luminance and the gray scale resolution of luminance which accords with a display screen. A gray scale controlling circuit 20 detects the maximum gray scale level of the luminance of a display screen in accordance with the supplied digital display signals RD, GD, BD, and generates a selection signal DSEL for selecting a conversion table of a display signal converting circuit 24. This selection signal DSEL also functions as a luminance control signal, and is supplied to the display signal converting circuit 24, as well as to a luminous frequency controller 2.

The display signal converting circuit 24 converts the respective 10-bit digital display signals RD, GD, BD to 10-bit converted digital display signals CRD, CGD, CBD via a conversion table, which conforms to a selection signal DSEL. The converted display signals are supplied to a display data controller 1, and are supplied to an address driver 7 as data signals. Further, in accordance with the selection signal DSEL, the luminous frequency controller 2 sets the luminous frequency Fsus of a sustained discharge.

The gray scale controlling circuit 20 has the same functions as the dynamic range and luminance control signal generating portion 10 in FIG. 1. But the gray scale controlling circuit 20 detects via a histogram the maximum gray scale level of the luminance of supplied digital display signals RD, GD, BD, and generates a selection signal DSEL. Then, the display signal converting circuit 24 converts the supplied digital display signals RD, GD, BD to converted digital display signals CRD, CGD, CBD so that the gray scale range of the supplied digital display signals from 0 to the detected maximum gray scale level correspond to the full range of gray scales following conversion. As a result thereof, when the detected maximum gray scale level is lower, the digital display signals are converted so that gray scale resolution in a low luminance region becomes higher. In accordance with such conversion, the dynamic range of the converted digital display signals becomes substantially narrower.

Therefore, because the substantial narrowing of the dynamic range makes it necessary to lower the real luminance corresponding to the maximum gray scale, the luminous frequency Fsus is set lower by a selection signal DSEL, which also functions as a luminance control signal.

Figure 10:
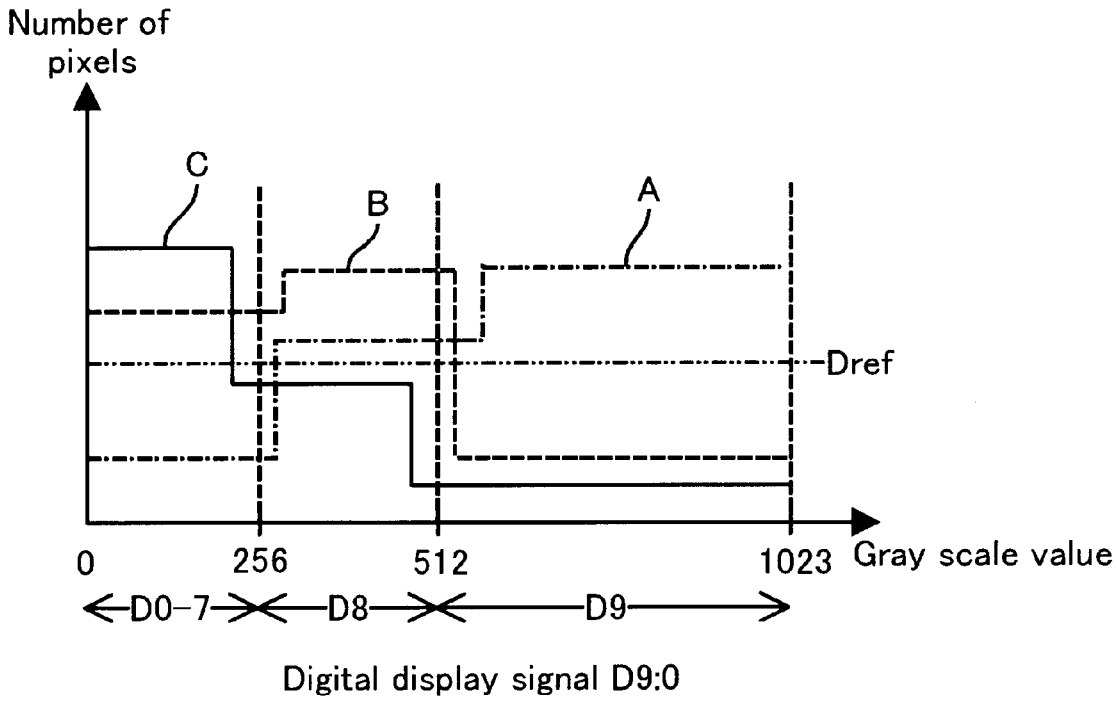
FIG. 10 is a diagram of a histogram showing the distribution state of digital display signals in a gray scale controlling circuit 20.

FIG. 10 is a diagram of a histogram showing the distribution state of digital display signals in the gray scale controlling circuit 20. The horizontal axis represents the gray scale values of a 10-bit digital display signal D9:0, and the vertical axis represents the number of pixels. This histogram shows the number of pixels for gray scale values in 1 frame or a plurality of frame periods partitioned, for example, by a vertical synchronization signal Vsync.

In the example of distribution A, in the high gray scale level of gray scale values 512 to 1023, the number of pixels are even higher than the reference value Dref. That is, distribution A is a picture in which brighter pixels are numerous, and corresponds, for example, to examples 1), 2), 3) shown in FIG. 4. Distribution B has a higher number of pixels than the reference value Dref in the next highest gray scale level of gray scale values 256 to 512, but in the highest gray scale level of gray scale values 512 to 1023, the number of pixels are lower than the reference value Dref. Therefore, distribution B is a screen in which rather bright pixels are numerous, but the number of bright pixels are less than in distribution A. And this picture corresponds, for example, to examples 4), 5) shown in FIG. 4. Lastly, distribution C is an example in which the number of pixels do not exceed the reference value Dref beyond gray scale value 256, making for a dark image. That is, this picture corresponds to example 6) of FIG. 4.

In the above-mentioned distributions A, B, C, distribution A is an example in which the maximum gray scale level of luminance is the highest, distribution B is an example in which the maximum gray scale level is the next highest thereto, and distribution C is an example in which the maximum gray scale level is the lowest. The differentiation of these distributions, as is clear from FIG. 10, becomes possible by counting the number of pixels of the most significant bit D9 and the subsequent upper bit D8 of a digital display signal. That is, if the number of pixels of the most significant bit D9 exceeds the reference value Dref, distribution A can be inferred. Further, when the number of pixels of the subsequent upper bit D8 of a digital display signal exceeds the reference value Dref, but the number of pixels of the most significant bit D9 does not exceed the reference value, distribution B can be inferred. And when the number of pixels of the most significant bit D9 and the upper bit subsequent thereto D8 do not exceed the reference value Dref, distribution C, the darkest screen, can be inferred.

Figure 11:
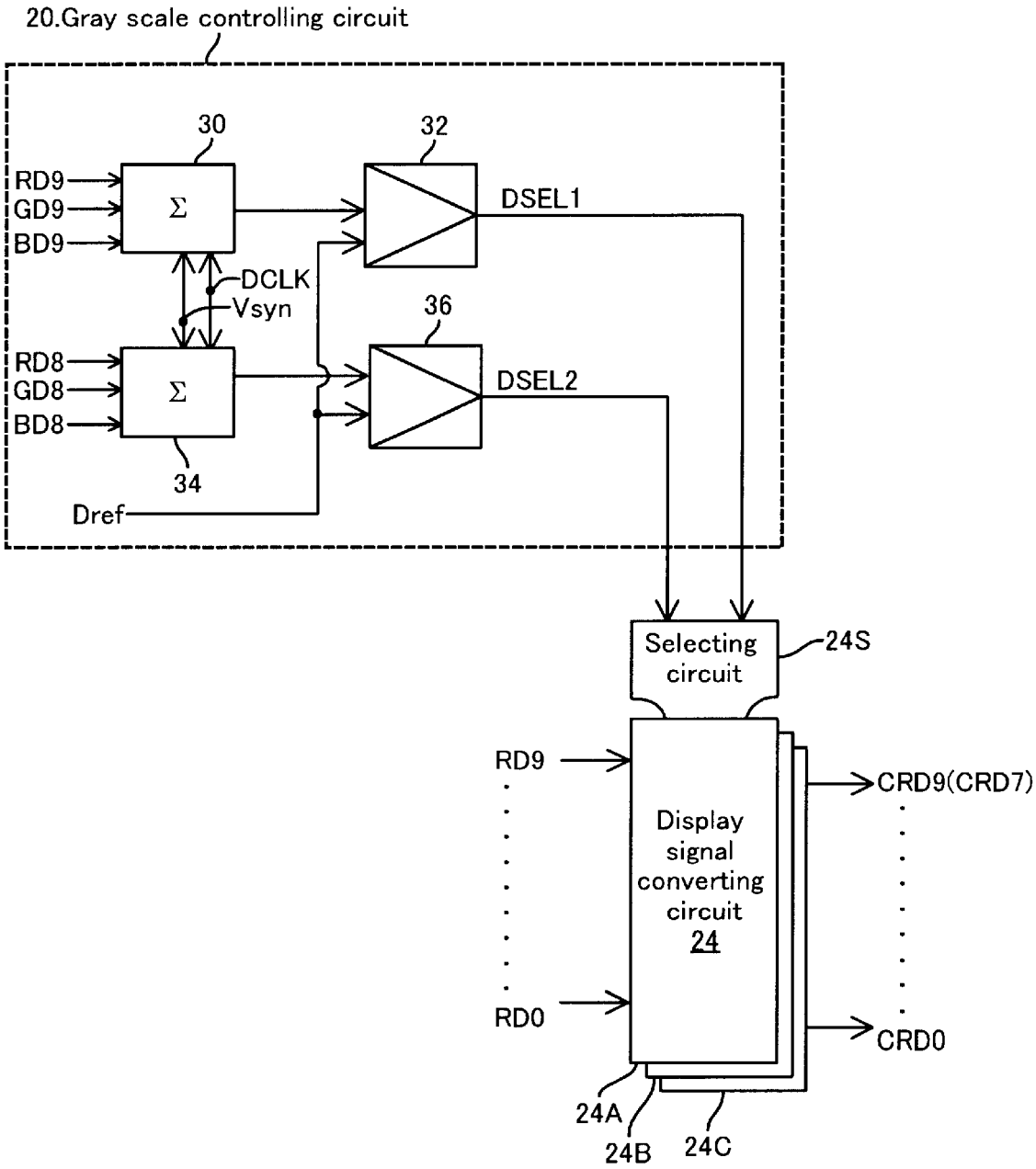
FIG. 11 is a diagram showing the constitutions of a gray scale controlling circuit and a display signal converting circuit.

FIG. 11 is a diagram showing the constitutions of a gray scale controlling circuit and a display signal converting circuit. The gray scale controlling circuit 20 has a counting circuit 30 for counting in synchronization with a dot clock DCLK the most significant bits RD9, GD9, BD9 of digital display signals, and a counting circuit 34 for counting the subsequent upper bits RD8, GD8, BD8. These counting circuits output, every frame in synchronization with a vertical synchronization signal Vsync, a cumulative count value in a prescribed number of frame periods.

The gray scale controlling circuit 20 also has comparing circuits 32, 36 for comparing a count value and a reference value Dref. Comparing circuit 32 sets selection signal DSEL1 to H level when the number of most significant bits exceeds the reference value Dref. Further, comparing circuit 36 sets a second selection signal DSEL2 to H level when the number of subsequent upper bits exceeds the reference value Dref. The 2-bit selection signal thereof DSEL1,2 is supplied to a selecting circuit 24S of the display signal converting circuit 24.

The display signal converting circuit 24 converts a 10-bit supplied digital display signal RD9:0, for example, into a 10-bit converted digital display signal CRD9:0. And then in the example of FIG. 11, converting circuits 24A, B, C are provided in accordance with 3 types of conversion tables, and these converting circuits 24A, B, C are selected in accordance with the selection signals DSEL1,2. In FIG. 11, the only converting circuit shown is the converting circuit for a red digital display signal. The selection signals DSEL1,2 are the signals, which discriminate between distribution A, the brightest screen, distribution B, the next brightest screen, and distribution C, the darkest screen, as shown in FIG. 10.

Furthermore, in FIG. 11, only the converting circuit for a red digital display signal is shown, but in reality, converting circuits for green and blue digital display signals GD, BD are also provided.

Figures 12A, 12B:
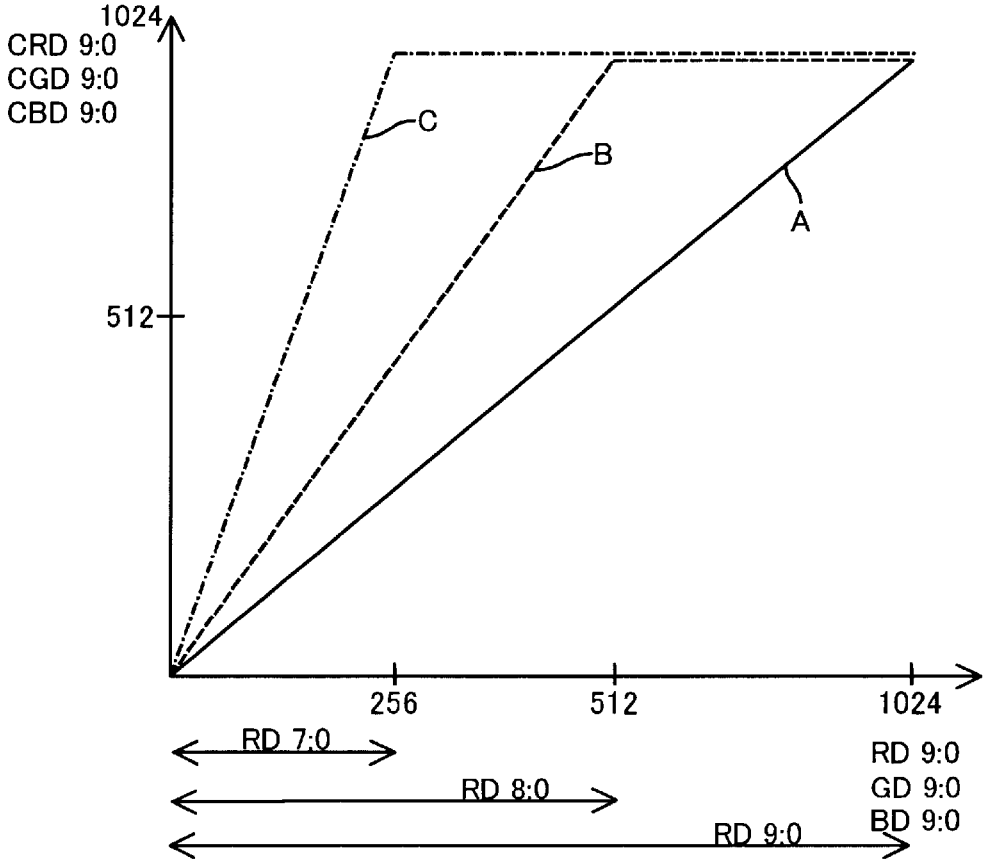
FIG. 12 is a table showing the relationship between histogram distributions and selection signals, and a diagram showing examples of the conversion tables therefor.

FIG. 12 is a table showing the relationship between histogram distributions and selection signals, and a diagram showing an example of a conversion table therefor. When the histogram distribution is A, the first bit DSEL1 of the selection signal DSEL constitutes H level. At this time, a 10-bit supplied digital display signal RD9:0 is converted to a 10-bit converted digital display signal CRD9:0. The conversion characteristic (conversion table) therefor, as shown in the characteristic diagram of the conversion table shown in FIG. 12B, has the characteristic, which converts the 0–1023 gray scale range of a supplied digital display signal RD to a 0–1023 gray scale range of a converted digital display signal CRD. Characteristic A shown in FIG. 12B does not necessarily have to be a straight line, but rather, when gamma characteristics are taken into consideration, can also be a characteristic curve, wherein resolution becomes higher in a low gray scale region.

When the histogram distribution is B, the second bit signal DSEL2 of the selection signal DSEL constitutes H level. At this time, the lower 9 bits RD8:0 of a supplied digital display signal are converted to a 10-bit converted digital display signal CRD9:0. That is, conversion table B shown in FIG. 12B is the transfer characteristic example. According to this transfer characteristic, the 0–511 gray scale range of the supplied digital display signal RD is converted to a 0–1023 gray scale range of a converted digital display signal CRD. Because the number of pixels for which the most significant bit RD9 constitutes 1 is small, all gray scales of 511 or more are allocated to the maximum gray scale level. Therefore, according to the converted digital display signal, gray scale resolution becomes higher in a low gray scale region.

When the histogram distribution is C, both bit signals DSEL1,2 of the selection signal DSEL become L level. At this time, the lower 8 bits RD7:0 of a supplied digital display signal are converted to a 10-bit converted digital display signal CRD9:0. That is, conversion table C shown in FIG. 12B is the conversion characteristic example. According to this conversion characteristic, the 0–255 gray scale range of the supplied digital display signal RD is converted to a 0–1023 gray scale range of a converted digital display signal CRD. Because the number of pixels for which the most significant bit RD9 and the subsequent upper bit RD8 constitute 1 is small, all gray scales of 255 or more are allocated to the maximum gray scale level. Therefore, according to the converted digital display signal, gray scale resolution becomes even higher in a low gray scale region.

According to the conversion tables shown in FIG. 12B, in the case of conversion table A, the 1024 maximum gray scale of a supplied digital display signal corresponds as-is to the 1024 maximum gray scale of a post-conversion digital display signal CRD. However, in the case of conversion table B, the 512 gray scale of a supplied digital display signal corresponds to the 1024 maximum gray scale of a converted digital display signal CRD. Further, in the case of conversion table C, the 256 gray scale of a supplied digital display signal corresponds to the 1024 maximum gray scale of a converted digital display signal CRD.

Therefore, in the cases of conversion tables B, C the maximum gray scale level of the luminance that should actually be displayed becomes 2-fold or 4-fold. Therefore, the same as in the case of the first embodiment, in order to adjust the actual luminance to be displayed in accordance with the conversion of a digital display signal, it is also necessary to adjust the luminous frequency Fsus.

Figure 13:
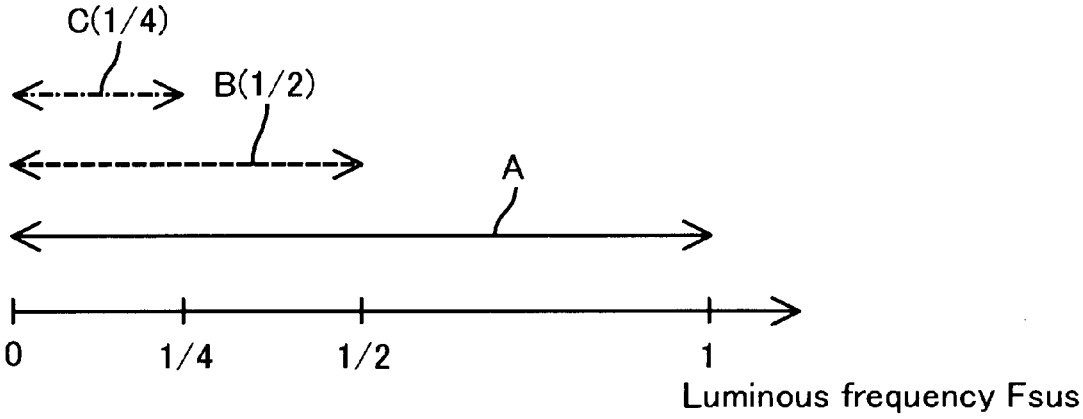
FIG. 13 is a diagram for explaining the operation of a luminous frequency controller.

FIG. 13 is a diagram for explaining the operation of a luminous frequency controller. In the case of distribution A, the luminous frequency Fsus is controlled to the maximum frequency by the luminous frequency controller 2. Further, in the case of distribution B, the luminous frequency Fsus is controlled to ½ the maximum frequency. And in the case of distribution C, the luminous frequency Fsus is controlled to ¼ the maximum frequency. But, in addition to a selection signal DSEL indicating the above-mentioned distributions, an external luminance adjustment signal BCA supplied from outside is also supplied to the luminous frequency controller. The upper limit value of the luminous frequency is controlled by this external luminance adjustment signal BCA. Therefore, a luminous frequency, which conforms to a selection signal DSEL having the function of a luminance control signal, is selected in a range that does not exceed the upper limit value of the luminous frequency, which is controlled by this external luminance adjustment signal BCA.

Further, the luminous frequency controller 2 receives consumed current data feedback from each of the X driver 5, Y driver 6, and address driver 7 driving drivers, and controls luminous frequency so that the consumed power of the display unit 8 is rated, and does not exceed an established fixed value. Therefore, the luminous frequency controller 2 selects a luminous frequency Fsus, which conforms to a selection signal DSEL, in a range that does not exceed the upper limit value of a luminous frequency limited by the above-mentioned external luminance adjustment signal BCA, and consumed current data.

FIG. 14 is a table showing the relationship between different histogram distributions and selection signals, and a diagram showing examples of the conversion tables therefor. The example of FIG. 14 is one in which the post-conversion digital display signal CRD of the display signal converting circuit 24 of FIG. 11 is 8 bits. That is, it is an example, wherein a 10-bit supplied digital display signal RD9:0 is converted to an 8-bit converted digital display signal CRD7:0.

Figures 14A, 14B:
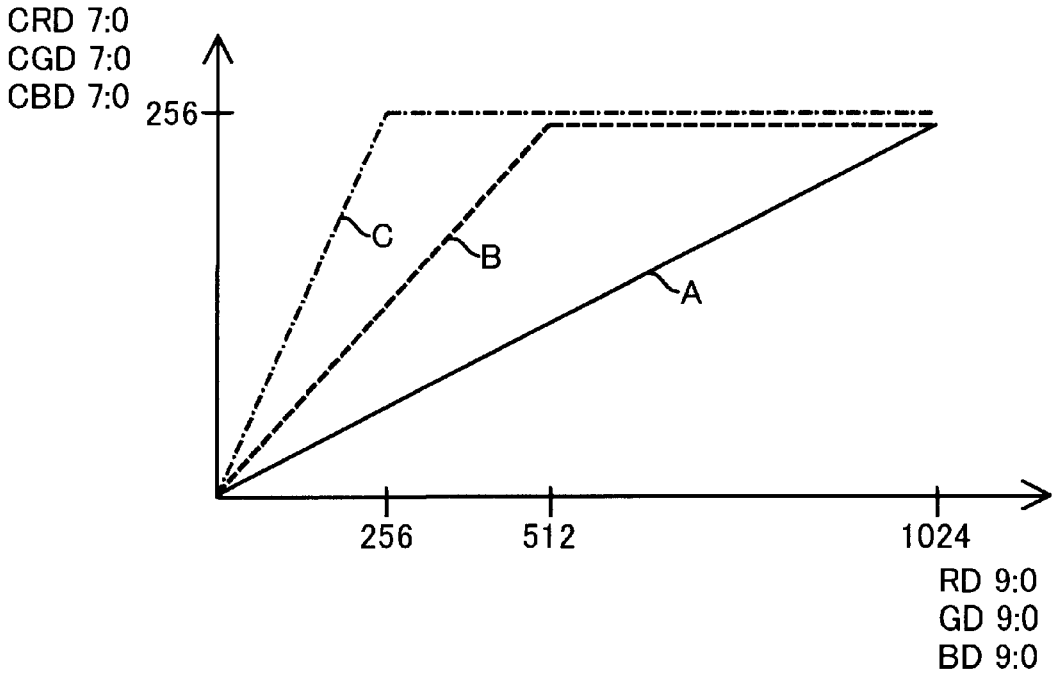
FIG. 14 is a table showing the relationship between different histogram distributions and selection signals, and a diagram showing examples of the conversion tables therefor.

The combination of selection signals DSEL corresponding to distributions A, B, C of the histogram are the same as the case of FIG. 12. But the conversion tables differ. When the selection signals DSEL1,2 that detects distribution A are equal to H, X (where X is either H or L), in the converting circuit, the upper 8-bit signal RD9:2 of the supplied digital display signal RD9:0 is made to correspond to an 8-bit converted digital display signal CRD7:0. That is, as shown in FIG. 14B, the 0–1023 gray scale range of a supplied digital display signal RD is made to correspond to the 0–255 gray scale range of an 8-bit converted digital display signal CRD. But gray scale resolution becomes poor.

When the selection signals DSEL1,2 that detects distribution B are equal to L, H, a 1-bit lower-side-shifted signal RD8:1 of a supplied digital display signal RD9:0 is made to correspond to an 8-bit converted digital display signal CRD7:0. That is, as shown in FIG. 14B, the 0–511 gray scale range of the supplied digital display signal RD is made to correspond to the 0–255 gray scale range of an 8-bit converted digital display signal CRD.

Furthermore, when the selection signals DSEL1,2 that detects distribution C are equal to L, L, a 2-bit lower-side-shifted signal RD7:0 of a supplied digital display signal RD9:0 is made to correspond to an 8-bit converted digital display signal CRD7:0. That is, as shown in FIG. 14B, the 0–255 gray scale range of the supplied digital display signal RD is made to correspond to the 0–255 gray scale range of an 8-bit converted digital display signal CRD.

As is clear from FIG. 14B, gray scale resolution in a low gray scale region is higher for conversion tables B, C than for conversion table A. Therefore, conversion tables B, C can provide sufficient gray scale resolution even for a dark picture.

In the case of the example of FIG. 14, the control of luminous frequency is also as described hereinabove. By comparison to the luminous frequency Fsus corresponding to conversion table A, luminous frequency is controlled to ½ in the case of B, and luminous frequency is controlled to ¼ in the case of C.

In the case of the converting circuit shown in FIG. 14, a multiplexer can also be utilized in the display signal converting circuit. That is, in the case of distribution A, of a 10-bit supplied digital display signal RD9:0, an upper 8-bit signal RD9:2 is selected. Further, in the case of distribution B, of a 10-bit supplied digital display signal RD9:0, an upper 8-bit signal RD8:1, which is shifted 1 from signal RD9:2, is selected. And in the case of distribution C, of a 10-bit supplied digital display signal RD9:0, an upper 8-bit signal RD7:0, which is further shifted 2 from signal RD9:2, is selected.

The second embodiment explained hereinabove is a display device, which performs a display operation by a luminance gray scale being controlled in accordance with a supplied digital display signal, and by luminance being controlled in accordance with a luminance control signal; wherein, when the maximum gray scale level of luminance in accordance with the supplied digital display signal RD during a prescribed period of a plurality of frame periods or the like is a first gray scale level of a range of 512–1023, a display signal converting circuit converts the supplied digital display signal so that the gray scale range of the supplied digital display signal from 0 to a first gray scale level 1023 corresponds to the full range of a converted digital display signal CRD. Further, when the maximum gray scale level of luminance is a second gray scale level (256–511) which is lower than the first gray scale level (512–1023), the display signal converting circuit converts the supplied digital display signal RD so that the gray scale range of the supplied digital display signal from 0 to a second gray scale level 511 corresponds to the full range of a converted digital display signal. As shown in FIG. 12B and FIG. 14B, when conversion characteristics A and B are compared, gray scale resolution in a low luminance region becomes higher for the conversion characteristic B than A.

Furthermore, in the second embodiment, a luminance controlling circuit, which comprises a gray scale controlling circuit 20, and a luminous frequency controller, controls the above-mentioned luminance control signal DSEL so as to set a display at a first luminance when the maximum gray scale level is a first gray scale level (512–1023), and controls the luminance control signal DSEL so as to set a display at a second luminance (½ times the luminous frequency), which is lower than a first luminance, when the maximum gray scale level is a second gray scale level (256–511).

Now, the display signal converting circuit 24, in the example of FIG. 12, converts a 10-bit (N-bit) supplied digital display signal to a 10-bit (M-bit) converted digital display signal when the maximum gray scale level is a first level (512–1023), and converts a lower 9-bit (N−1) supplied digital display signal to a 10-bit (M-bit) converted digital display signal when the maximum gray scale level is a second level (256–511).

Further, the display signal converting circuit 24, in the example of FIG. 14, converts the upper 8 bits (L bits) RD9:2 of a 10-bit (N-bit) supplied digital display signal to a converted digital display signal when the maximum gray scale level is a first gray scale level (512–1023), and converts a supplied digital display signal RD8:1 of 8 bits (L bits), which is lower by 1 bit, to a converted digital display signal when the maximum gray scale level is a second gray scale level (256–511).

By way of summarizing the above-described first and second aspects of the embodiment, as an even higher order concept, the present invention is a display device, which performs a display operation by a luminance gray scale being controlled in accordance with a supplied digital display signal, and luminance being controlled in accordance with a luminance control signal, wherein, when the maximum gray scale level of luminance possessed by a supplied display signal is a first gray scale level, the supplied display signal is converted to a converted display signal via a first conversion characteristic, which allocates to the full range of a post-conversion gray scale a gray scale range from 0 to the first gray scale level of the supplied display signal, and the luminance control signal is controlled so that a first maximum luminance is displayed, and when the maximum gray scale level of luminance possessed by the supplied display signal is a second gray scale level, which is lower than the first gray scale level, the supplied display signal is converted to the converted display signal via a second conversion characteristic, which allocates to the full range of a post-conversion gray scale a gray scale range from 0 to the second gray scale level of the supplied display signal, and the luminance control signal is controlled so that a second maximum luminance, which is lower than the first maximum luminance, is displayed.

A plasma display device is used as an example hereinabove in explaining the aspects of the embodiment, but the present invention is not limited thereto, and a display device such as a liquid crystal display device can also be used.

As described above, according to the present invention, when converting an analog picture signal to a digital display signal, since the dynamic range of an A/D converter is changed and set in accordance with the analog picture signal, it is possible to convert to a digital display signal while maintaining gray scale resolution as high as possible, and by dynamically changing and setting the luminance (brightness) of a picture to coincide with the analog picture signal, a proper luminance corresponding to the picture signal can be displayed.

Further, according to the present invention, because a supplied display signal is converted to a display signal having a gray scale resolving power that is optimum for the picture being specified, and an image is displayed in accordance with the converted display signal thereof, it is possible to display a picture having the optimum gray scale resolving power (gray scale resolution).

What is claimed is:

1. A display for displaying a picture with a luminous gray scale according to a digital display signal converted from an analog picture signal, and with a luminance corresponding to the analog picture signal according to a luminance control signal, comprising:

an interface device, including an analog-digital converting circuit converting the analog picture signal into the digital display signal, in which a dynamic range of the analog-digital converting circuit and the luminance control signal are set, according to the maximum level of the analog picture signal during a predetermined period.

2. The display device according to claim 1, wherein the interface device further changes the settings of the dynamic range and the luminance control signal, according to an average value of the analog picture signal during the predetermined period.

3. The display device according to claim 1, wherein when the maximum level of the analog picture level is lower, the dynamic range is set to a smaller value and the luminance control signal is set to a signal for displaying lower luminance.

4. The display device according to claim 2, wherein when the average value of the analog picture level is lower than the maximum level, the dynamic range is set to a smaller value and the luminance control signal is set to a signal, for displaying lower luminance.

5. An interface device connected to a display device for displaying a luminance gray scale in accordance with a digital display signal that has been converted from an analog picture signal, and also for displaying luminance corresponding to said analog picture signal in accordance with a luminance control signal, the interface device comprising:

an analog-digital (A/D) converting circuit for converting said analog picture signal to said digital display signal, wherein a dynamic range of said A/D converting circuit and said luminance control signal are set in accordance with the maximum level during a prescribed period of said analog picture signal.

6. A display device, which performs a display operation by a luminance gray scale being controlled in accordance with a supplied digital display signal, and by luminance being controlled in accordance with a luminance control signal, wherein, when the maximum gray scale level of said supplied digital display signal luminance during a prescribed period is a first gray scale level, said supplied digital display signal is converted to a converted digital display signal via a first conversion characteristic for allocating to the full range of a post-conversion gray scale a gray scale range from a lower gray scale level to the first gray scale level of said supplied digital display signal, and said luminance control signal is controlled so as to display a first maximum luminance; and when said maximum gray scale level is a second gray scale level, which is lower than said first gray scale level, said supplied digital display signal is converted to a converted digital display signal via a second conversion characteristic for allocating to the full range of a post-conversion gray scale a gray scale range from a lower gray scale level to the second gray scale level of said supplied digital display signal, and said luminance control signal is controlled so as to display a second maximum luminance that is lower than the first maximum luminance.

7. The display device according to claim 6, wherein a determination as to whether said maximum gray scale level is said first gray scale level or said second gray scale level is performed in accordance with whether or not the number of pixels having prescribed upper bit of said supplied digital display signal is larger than a reference pixel number.

8. The display device according to claim 6, wherein, in addition to said first, second gray scale levels, a lower third gray scale level is determined, and the determination is performed in accordance with whether or not the number of pixels having the most significant bit and the second upper bit of said supplied digital display signal are larger than a reference pixel number.

9. The display device according to claim 6, wherein during conversion of said display signal, an N-bit supplied digital display signal is converted to an M-bit converted digital display signal, where M is equal to or different from N, when the maximum gray scale level is the first gray scale level, and a lower N−1 bit supplied digital display signal is converted to said M-bit converted digital display signal when the maximum gray scale level is the second gray scale level.

10. The display device according to claim 6, wherein during conversion of said display signal, the upper L (L<N) bits of an N-bit supplied digital display signal are converted to an L bits converted digital display signal when the maximum gray scale level is the first gray scale level, and an L-bit supplied digital display signal that is lower than said upper L bits is converted to an L bits converted digital display signal when the maximum gray scale level is the second gray scale level.

11. A control method for a display device, which performs a display operation by a luminance gray scale being controlled in accordance with a supplied digital display signal, and by luminance being controlled in accordance with a luminance control signal, wherein, when the maximum gray scale level of said supplied digital display signal luminance during a prescribed period is a first gray scale level, said supplied display signal is converted to a converted display signal via a first conversion characteristic for allocating to the full range of a post-conversion gray scale a gray scale range from a lower gray scale level to the first gray scale level of said supplied display signal, and said luminance control signal is controlled so as to display a first maximum luminance; and when said maximum gray scale level is a second gray scale level that is lower than said first gray scale level, said supplied display signal is converted to a converted display signal via a second conversion characteristic for allocating to the full range of a post-conversion gray scale a gray scale range from a lower gray scale level to the second gray scale level of said supplied display signal, and said luminance control signal is controlled so as to display a second maximum luminance that is lower than the first maximum luminance.

12. A display device, which performs a display operation by a luminance gray scale being controlled in accordance with a supplied display signal, and by luminance being controlled in accordance with a luminance control signal, wherein, when the maximum gray scale level of said supplied display signal luminance during a prescribed period is a first gray scale level, said supplied display signal is converted to a converted display signal via a first conversion characteristic for allocating to the full range of a post-conversion gray scale a gray scale range from a lower gray scale level to the first gray scale level of said supplied display signal, and said luminance control signal is controlled so as to display a first maximum luminance; and when said maximum gray scale level is a second gray scale level, which is lower than said first gray scale level, said supplied display signal is converted to a converted display signal via a second conversion characteristic for allocating to the full range of a post-conversion gray scale a gray scale range from a lower gray scale level to the second gray scale level of said supplied display signal, and said luminance control signal is controlled so as to display a second maximum luminance that is lower than the first maximum luminance.

13. A display for displaying a picture whith a luminous gray scale according to a supplied digital display signal, and with a luminance corresponding to the supplied digital display signal according to a luminance control signal, comprising:

a display signal converting circuit convering the supplied digital display signal into a converted digital display signal, in which a dynamic range of the display signal converting circuit and the luminance control signal are set, according to the maximum level of the supplied digital display signal during a predetermined period.

* * * * *